United States Patent [19]

Meller et al.

[11] 4,098,465

[45] Jul. 4, 1978

[54] DEVICE FOR WET GRINDING

[76] Inventors: Karl Heinz Meller, Ernst-Merck-Strasse 12-14, D-2000 Hamburg 1, Fed. Rep. of Germany; Jacques Brenot, 24, Rue Taclet, F-75 020 Paris, France

[21] Appl. No.: 785,842

[22] Filed: Apr. 8, 1977

[30] Foreign Application Priority Data

Apr. 13, 1976 [DE] Fed. Rep. of Germany ..... 2616155

[51] Int. Cl.[2] ..... B02C 23/36

[52] U.S. Cl. ..... 241/43; 241/46.17; 241/153; 241/174; 241/179

[58] Field of Search ..... 241/43, 45, 46, 46.11, 241/46.17, 153, 171, 172, 173, 174, 179

[56] References Cited

U.S. PATENT DOCUMENTS

| | | | |
|---|---|---|---|
| 3,311,310 | 3/1967 | Engels et al. | 241/153 |
| 3,458,144 | 7/1969 | Lassells et al. | 241/46.17 |
| 3,523,566 | 10/1970 | Macquat | 241/153 |
| 3,527,419 | 9/1970 | Wienert | 241/153 |

*Primary Examiner*—Granville Y. Custer, Jr.
*Attorney, Agent, or Firm*—Martin A. Farber

[57] ABSTRACT

A wet grinding device having a container for receiving therein products to be ground as well as grinding balls, the container being equipped with a mixer, a delivery device for feeding the products to be ground into the container, a discharge outlet for the broken-up products, as well as a drive device for the mixer. The wet grinding device is characterized by an operating chamber divided into a plurality of grinding zones of increasing volume, the operating chamber including a mixer shaft therethrough, the latter being rotatably horizontally supported by the container. The shaft is provided with blades which have a diameter which is proportional to the diameter of the respective grinding zones.

13 Claims, 6 Drawing Figures

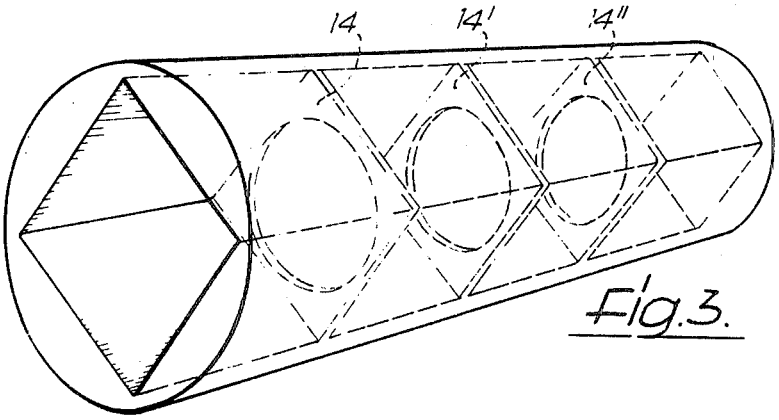
Fig.3.
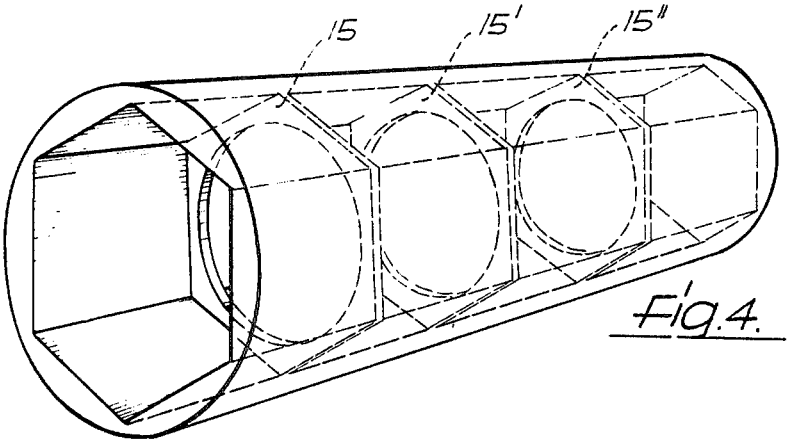
Fig.4.
Fig.5.
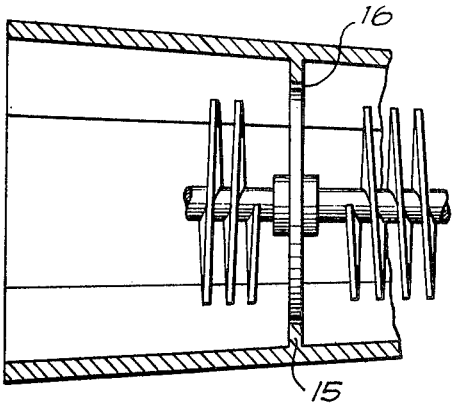
Fig.6.
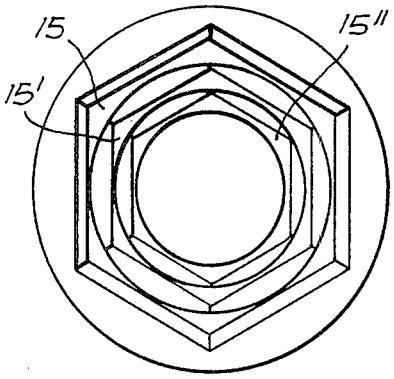

DEVICE FOR WET GRINDING

The invention relates to a wet grinding device, comprising a container, equipped with an agitator or mixer, the container for receiving products to be ground as well as grinding balls, a delivery device for feeding the products to be ground into the container, and an outlet discharge for the broken-up or reduced products, as well as a drive device for the mixer.

Devices for the wet grinding of solid materials are known, for example from German Offenlegungsschrift OS 2 125 888, in which the materials to be reduced are pumped through a series of grinding chambers of a container which is divided by vertical or perpendicular separation walls, whereby a continuous transfer of the products to be reduced takes place from one chamber into the other chamber, and each of the equally large chambers is equipped with a vertically or perpendicularly standing rotating mixer.

Characteristically for the known devices for wet grinding of this type, there is a comparatively complicated construction, which brings about disadvantages in the production costs, operating costs and servicing costs. Further the known devices are disadvantageous in that the grinding effect which can be obtained by them in no manner is optimum from an economical point of view.

It is an object of the present invention to develop a wet grinding device which offers decisive advantages with respect to the previously known wet grinding and particularly is distinguished by:

1. A simplified construction, and reduced production costs and service costs thereby dependent thereon;
2. An improved effective output;
3. A reduced weight and a reduced size.

The invention is based on the recognition that a practically ideal wet grinding device may be produced in such a manner where one departs from the known principle of use of vertical or perpendicular standing, grinding chambers of equal size, and in place of this utilizes an operating chamber which is divided or broken-down into a plurality of grinding zones of increasing volume, the chamber resting horizontally or practically horizontally on a shaft, which shaft simultaneously is formed as the mixer and the diameter of the blades thereof are adjusted to the diameter of the grinding zones.

This realization leads essentially to the following concepts:

(a) a grinding effect is brought about in the manner that a particle to be reduced or crushed arrives between two violently colliding balls and thereby is reduced;

(b) a wet grinding process runs continuously, that is, the particles to be reduced become continuously smaller in the course of the grinding process;

(c) the number of the contact surfaces should be proportional to the number of the particles to be reduced;

(d) the grinding phase duration for coarse particles or agglomerates, that is the grinding duration in the phases or the first phases of the grinding process is shorter than the duration of the grinding phase for the smaller particles, that is the particles of the later phases of the grinding process;

(e) an ideal wet grinding device should be adjusted to the continuously changing requirements in the course of the grinding process;

(f) each grinding zone should have a maximum number of balls;

(g) the number of the balls in each grinding zone should be as large as possible;

(h) the number of balls should be proportional to the number of the particles to be reduced and the volume of a grinding zone should increase with the fineness of grain of the particles during the grinding process; and (i) the ball diameter should be adjusted at each moment of the grinding process to the size of the particles to be reduced.

The subject of the invention, accordingly, is a wet grinding device comprising a container for receiving the grinding products into the container, which container is equipped with an agitator or mixer, a discharge outlet for the reduced products as well as a drive device for the agitator. The device according to the invention is characterized by an operating chamber divided into a plurality of grinding zones of increasing volume, which operating chamber is horizontally or practically horizontally supported on a shaft, the latter simultaneously being constructed as the agitator, the blades of the latter having a diameter which is proportional to the diameter of the grinding zones.

With the above and other objects and advantages in view, the present invention will become more clearly understood in connection with the following detailed description of a preferred embodiment, when considered with the accompanying drawings, of which:

FIGS. 3 and 4 are perspective views of two different operating chambers which differ from one another by different types of inner walls and are illustrated without the inserted or mounted shaft;

Figure 1:
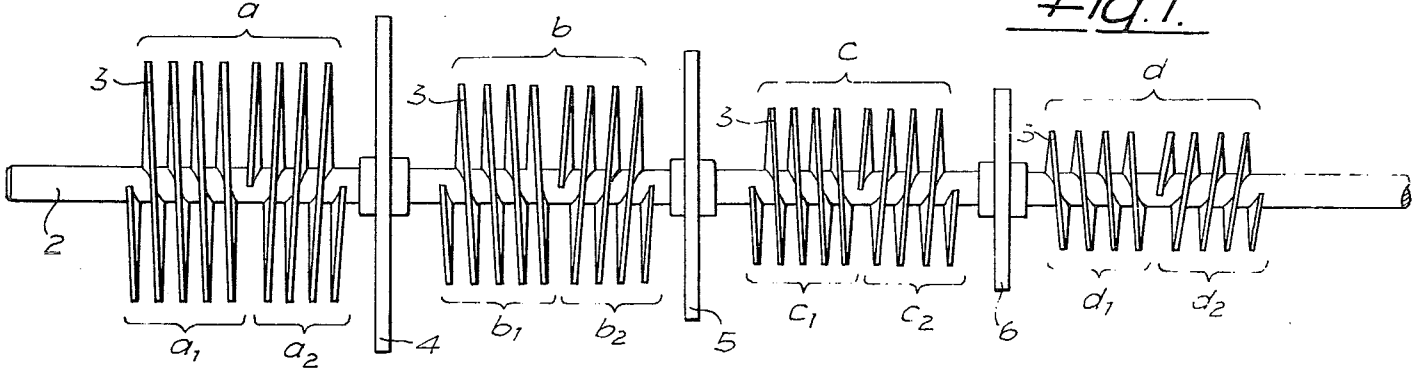
FIG. 1 is a side view of a shaft formed as a mixer or agitator.

FIG. 5 is a broken away side section through a part of an operating chamber; and FIG. 6 is a cross-sectional view through a chamber illustrated without the inserted or mounted shaft The shaft 2 which is illustrated in FIG. 1 and set for installation in an operating chamber has four helical or worm blade sections or mixer blade sections *a, b, c,* and *d,* which each are made of eight mixer blades 3. The individual sections *a, b, c* and *d* are limited by the separation discs 4, 5, and 6, the latter being seated on the shaft 2. The worm blade sections or mixer blade sections a, b, c and d, moreover are divided in counter effect two blade subsections $a_1$ and $a_2$, $b_1$ and $b_2$, $c_1$ and $c_2$, and $d_1$ and $d_2$, respectively i.e., each of these two blade subsections of each mixer blade section $a - d$, respectively, have counter-screw senses blades 3, the diameter of the operating chamber and the diameter of the discs 4 – 6 vary linearly in the same sense but in slightly different extents with the distance along the shaft 2 from its ends, i.e. the diameters of the blades and of the discs, respectively, increase or decrease essentially, depending on the selected shaft end, proportionally with the diameter of the chamber. Each blade subsection $a_1$, $a_2$, $b_1$, . . . , $d_2$ of the blade sections $a - d$ is mathematically seen as a helicoid or practically a helical screw or a "continuous worm".

Figure 2:
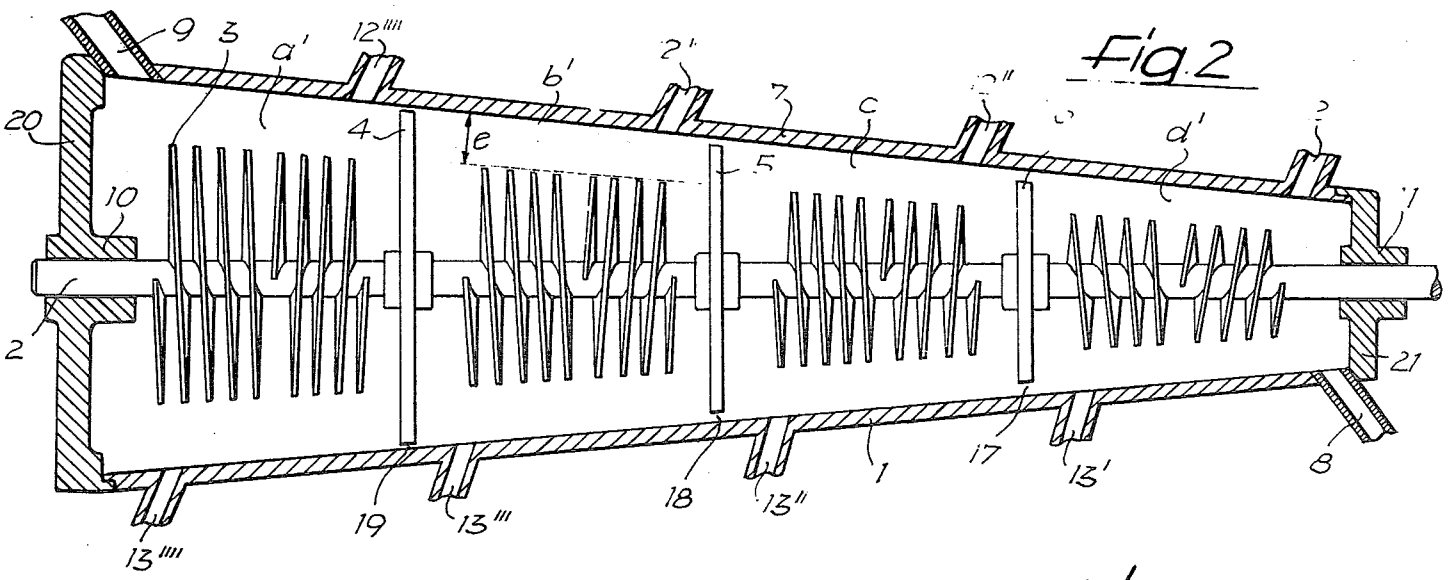
FIG. 2 is a sectional side view of an operating chamber of a wet grinding device according to the invention with four grinding zones.

FIG. 2 shows the arrangement of the shaft in an operating chamber 1 which has the shape of a truncated or frustoconical cone, the housing of which is adapted or correlated with the shaft, that is, the spacing of the separation discs 4, 5 and 6 from the inner chamber wall 7 decreases with increasing diameter of the separation discs 4, 5 and 6.

The chamber has an entrance opening 8 constituting a part of a delivery means for feeding the grinding material to be reduced and an exit opening 9 for the brokenup or reduced material. The shaft 2 is rotably mounted in the bearings 10 and 11 and is driven by a device (not illustrated) of conventional construction. The grinding zones *a'*, *b'*, *c'*, and *d'* which are formed by the separation discs 4, 5 and 6 have additional closeable openings 12' to 12'''' for the insertion of the grinding balls and closeable openings 13' to 13'''' for the removal of the grinding balls. However also a smaller number of openings for the insertion and removal of the balls can be provided, e.g., if less grinding zones are provided or if the separation discs are eliminated or decreased in diameter, so that the spacing of the discs from the inner chamber wall is increased for the passage of grinding balls therebetween Whereas the chamber 1 as illustrated in FIG. 2 has grinding zones with a round cross-section, the chambers which are illustrated in FIGS. 3 and 4 have angular or polygonal cross-sections. The chambers are divided by chamber walls 14, 14' and 14'' or 15, 15' and 15'', respectively, into corresponding chamber sections, whereby the chamber walls are adjusted or complementary to the separation discs 4, 5 and 6, the latter being seated on the shaft 2, with formation of passage openings 16 for the grinding products, as shown in FIG. 5.

The outer form or shape of the operating chamber is optional, that is the operating chamber 1, for example, can have a frustoconical shape (as in the illustrated embodiments), a pyramid, or the shape of several composite enlarging truncated cones and pyramids, respectively, or also of a plurality of increasing cylinders. The inner walls of the chambers, for example can have a round cross-section, however also a triangular cross-section, a quadrangular or square cross-section, a hexagonal cross-section or an octagonal cross-section, etc. The inner formation should be such that the construction of dead spaces bordered in a direction parallel to the shaft are avoided in order to prevent a deposition or stopping of grinding products and balls.

The shaft 2 should be horizontally or practically horizontally mounted. Practically horizontally means that the angle, which the shaft makes with the horizontal, preferably is not greater than 20°, however if necessary, it can be up to 90°.

As provided from FIGS. 2, 3, 4 and 5, the individual grinding zones are limited by the separation discs 4, 5 and 6, the latter rotating with the shaft 2. The diameter of the separation discs, in addition, is sized or dimensioned such that a gap 17, 18 and 19, respectively, remains between each separation disc and the chamber wall. This gap is dimensioned such that the grinding products can proceed from one grinding zone into the other grinding zone. The size of a gap is thereby adjusted to the size of the grinding products and the grinding balls. This means that the gap which is formed by a separation disc and a wall, respectively, is sufficiently large so that the grinding products can proceed from one zone into the adjacent following zone; the balls however due to their larger diameter remain in the individual grinding zones. The ball diameter thereby decreases in an advantageous manner from grinding zone to grinding zone. Furthermore the number of balls increases from grinding zone to grinding zone in an advantageous manner.

In FIGS. 1, 2 and 5 the individual blades of the mixer have the same form. However this is not necessary. Moreover the individual blades and/or the blades of the individual grinding zones have a different form from one another, for example, a width, gauge or diameter which is different from one another.

In an advantageous manner, the part sections for example, the two blade subsections, respectively, $a_1$ and $a_2$, $b_1$ and $b_2$, etc. of each of the worm blade sections or mixer blade sections *a*, *b*, etc. have counter screw senses, so that the material to be ground or crushed in each grinding zone is centrifuged during the rotation of the shaft in the direction of the center portion of each grinding zone by the respective two blade subsections.

The grinding products to be reduced or crushed are fed chargewise intermittently or continuously through the entrance opening 8 by means of a conventional pump (not illustrated). The output of the pump additionally is sized such that it can pump the products to be ground through the additional grinding zones and can subsequently press the products out of exit opening 9. The individual mixer or agitator blades which are seated on the shaft consequently merely have the function of moving the grinding products and the grinding balls (which are not illustrated in the drawings in order to provide a better overall view). The individual blades, however, under the circumstances, if necessary, can also be formed such that they assist the feeding of the grinding products from zone to zone, by positioning the two blade subsections ($a_1$,$a_2$, $b_1$, $b_2$, $c_1$, $c_2$, and $d_1$, $d_2$) of each blade section $a - d$ not in counter screw sense as shown in FIG. 1, but in the same sense so that the screw sense of all subsections is uniform over the entire shaft 2.

Characteristically for a wet grinding device in accordance with the present invention consequently is that the grinding products first enter into a comparatively small zone *d'*and from there arrive in always larger grinding zones (*c'*, *b'*and *a'*).

The number of individual grinding zones is not critical. This means that a wet grinding device in accordance with the present invention can have a different number of grinding zones, whereby the number of grinding zones is dependent on the requirements or demands on the degree of fineness of the grinding products to be produced. It has proven advantageous to provide at least three grinding zones in the wet grinding device. In an advantageous manner, a wet grinding device in accordance with the present invention has four to six grinding zones. However it is also possible to have up to eight, indeed up to twelve grinding zones.

The position of the entrance opening 8 in the first chamber section and the position of the exit opening 9 in the last chamber section is not critical, that is, the openings can for example also be disposed in the chamber walls 20 and 21, respectively. The exit opening 9 has a screen or filter, which is not illustrated, which prevents the exit of the grinding balls from the last grinding zone.

The volume of a device for wet grinding in accordance with the present invention likewise can be very different.

A volume of approximately 0.5 to 500 liters has proven advantageous with wet grinding devices in accordance with the present invention. Proven as particularly advantageous are devices with a volume of from 2 to approximately 200 liters, particularly 2 to 50 liters. In all cases the machines large or small are homothetic, i.e.

the devices result from affine transformations into one another.

A wet grinding device in accordance with the present invention is suited for wet grinding or comminution of the most different types of pigments, which customarily are wet ground. This means that a device in accordance with the present invention, for example, is suitable for the wet grinding of titanium dioxide, barium sulfate and chromium dioxide. A wet grinding device in accordance with the present invention is suited furthermore for production of the various dispersions and coating substances, particularly coating substances with pigments, by which a particularly fine distribution of the pigment is brought about, for example for the production of printing colors or inks, for example printer's ink, oil-construction colors, enamel lacquers, coating compositions for sound tapes with magnetic oxide particles and the like. Apart from the outstanding grinding effects which may be attained with the device in accordance with the present invention also outstanding mixing effects may be attained so that a device in accordance with the present invention can be used for carrying out of the most different mixing processes.

The grinding balls can consist of balls customary for wet grinding devices, for example, balls made of steel. Their diameter can be very different and for example can lie at 0.5 to 0.5 mm or beyond. It has proven advantageous if the ratio of the ball volume to grinding products in a chamber lies at approximately 1:1 to 10:1.

EXAMPLE 1:

A wet grinding device according to FIG. 2 with a capacity of 56 liters for example can have the following sizes:

volume of the grinding zone *a'*: 21.1 liters
volume of the grinding zone *b'*: 15.9 liters
volume of the grinding zone *c'*: 11.4 liters
volume of the grinding zone *d'* : 7.6 liters Weight, diameter and quantity of the grinding balls in the grinding zones:

| GRINDING ZONE | DIAMETER OF THE BALLS | WEIGHT OF THE BALLS (in kg) | APPROXIMATE NUMBER OF THE BALLS |
|---|---|---|---|
| a' | 1 mm | 30 | 4,300,000 |
| b' | 1.5 mm | 23 | 2,750,000 |
| c' | 2.5 mm | 17 | 680,000 |
| d' | 3.5 mm | 12 | 286,000 |

Width of the passage opening for the grinding material of:

grinding zone *d'* to grinding zone *c'*: 3 mm
grinding zone *c'* to grinding zone *b'*: 2 mm
grinding zone *b'* to grinding zone *a'*: 1 mm Distance "*e*" : $\frac{1}{3}$ the distance of the operating chamber wall to the axis of the shaft.

Output of the pump: up to 1300 liters per hour or more
Drive motor horsepower about 50/55 horsepower
Rotation of the shaft: differently, averaging 1300 revolutions per minute

EXAMPLE 2 (preferred)

A wet grinding device in accordance with the present invention has 3 grinding chambers, with a total capacity of approximately 38 liters and has the following dimensions:

length of the chamber = 800 mm
smaller diameter of the truncated cone = 200 mm
larger diameter of the truncated cone = 400 mm
volume of the first grinding zone = 5 liters
volume of the second grinding zone = 12 liters
volume of the third grinding zone = 21 liters the total weight and diameter of the grinding balls in the individual grinding zones are as follows:

in the first grinding zone = 6 kg and 3 mm, respectively
in the second grinding zone = 16 kg and 2 mm, respectively
in the third grinding zone = 22 kg and 1 mm, respectively Further data is as follows:

pump output is up to 1300 liters per hour
motor output is approximately 40 horsepower (29.42 kW)
rotational speed of the shaft is variable, on the average of 1300 rotations per minute.

While the outer shape of the three grinding chambers or zones is that of a truncated cone, their inner shape is that of a pyramid-frustrum with a regular pentagon base.

We claim:

1. A wet grinding device having a container for receiving therein products to be ground as weel as grinding balls, the container being equipped with a mixer, a delivery device for feeding the products to be ground into the container, a discharge outlet for the broken-up products, as well as a drive device for the mixer, comprising an operating chamber divided into a plurality of grinding zones of increasing diameter and volume,
a mixer shaft rotatably extending through and supported by said operating chamber and substantially horizontally disposed, said shaft constituting a mixer and including a plurality of blades in said plurality of grinding zones having a diameter proportional to the diameter of said grinding zones, respectively.

2. The device as set forth in claim 1, wherein
said operating chamber has the form of a truncated cone and said grinding zones have the form of conical segments.

3. The device as set forth in claim 1, further comprising separation discs mounted on said shaft and rotating with said shaft, said separation discs limit each of said grinding zones.

4. The device as set forth in claim 3, wherein
said operating chamber has an inner wall,
said separation discs have increasing diameters, respectively,
said separation discs are spaced from said inner wall of said operating chamber by distances which decrease with increasing diameter of said separating discs, respectively.

5. The device as set forth in claim 2, wherein
said operating chamber has a frustoconical shape defining a frustoconical diameter,
said frustoconical diameter decreases with the volume of said grinding zones, respectively.

6. The device as set forth in claim 1, wherein
the number of the grinding balls in each of said grinding zones increases with the volume of the grinding zones, respectively.

7. The device according to claim 1, wherein each of said blades of said mixer has an outer edge, said operating chamber has an inner wall, and the distance from said inner wall of said operating chamber to said outer edges of said blades, respectively, amounts to $\frac{1}{4}$ to $\frac{1}{2}$ of the distance from said inner wall to the axis of said shaft.

8. The device as set forth in claim 1, wherein said blades form a plurality of two counter mixer blade subsections, each of said two counter mixer blade subsections are disposed in each of said grinding zones, respectively, said two counter mixer blade subsections are formed with counter screw senses, respectively.

9. A wet grinding device comprising a container for receiving therein a product to be ground and grinding balls, a mixer, as well as a drive device for the mixer, comprising said container defining an operating chamber divided into at least two grinding zones following one another and having different diameters and volumes, and forming a discharge outlet for a ground product, delivery means for feeding said product to be ground into and through said operating chamber.

a mixer including a shaft supported by said container and having blades arranged in said operating chamber, and adapted to be driven by the drive device, said blades defining a diameter, respectively, the diameter of said blades and the diameters of said grinding zones, respectively, vary linearly in the same sense with distance along said shaft.

10. The device as set forth in claim 9, wherein said at least two grinding zones are of increasing volume.

11. The device as set forth in claim 9, wherein said container and said shaft are horizontally disposed.

12. The device as set forth in claim 9, wherein the diameter of said blades, respectively, and the diameters of said grinding zones vary in the same extent with said distance along said shaft.

13. The device as set forth in claim 9, wherein said blades comprise one blade section in each of said grinding zones, said one blade section constitutes two blade subsection means for axial feeding of the product to be ground in counter axial directions.

* * * * *